US005903993A

United States Patent [19]

Maticko et al.

[11] Patent Number: 5,903,993

[45] Date of Patent: May 18, 1999

[54] CONNECTORS, DISPLAY FRAME APPARATUS AND METHOD OF USE

[75] Inventors: John R. Maticko, Fairfax, Va.; David S. Chapin, Raleigh, N.C.; Arthur G. Carr, Washington, D.C.; Scott A. Boothby, Wooster, Ohio

[73] Assignee: Nomadic Structures, Inc., Springfield, Va.

[21] Appl. No.: 08/799,353

[22] Filed: Feb. 14, 1997

[51] Int. Cl.[6] ..... G09F 7/22

[52] U.S. Cl. ..... 40/757; 40/617; 40/558; 248/479

[58] Field of Search ..... 40/757, 617, 584, 40/558; 248/289.11, 479

[56] References Cited

U.S. PATENT DOCUMENTS

| | | |
|---|---|---|
| 253,520 | 2/1882 | Du Bois . |
| 976,198 | 11/1910 | Merritt . |
| 1,032,143 | 7/1912 | Katusky . |
| 1,064,039 | 6/1913 | Wise . |
| 1,479,799 | 1/1924 | Forsyth . |
| 2,031,718 | 2/1936 | Kress . |
| 2,187,870 | 1/1940 | Veccia . |
| 2,281,220 | 4/1942 | Anderson . |
| 2,290,430 | 7/1942 | Heiser . |
| 2,499,747 | 3/1950 | Griffith . |
| 2,989,788 | 6/1961 | Kessler . |
| 3,218,097 | 11/1965 | Bowers et al. . |
| 3,645,569 | 2/1972 | Reilly . |
| 3,698,114 | 10/1972 | Hirsch et al. . |
| 3,782,054 | 1/1974 | Goss, Jr. . |
| 3,854,831 | 12/1974 | Gutner . |
| 3,866,380 | 2/1975 | Benson . |
| 4,105,348 | 8/1978 | Anderson et al. . |
| 4,205,470 | 6/1980 | Kapnek . |
| 4,636,105 | 1/1987 | Johansson . |
| 4,683,634 | 8/1987 | Cole . |
| 4,862,612 | 9/1989 | Sugihara et al. . |
| 4,930,924 | 6/1990 | Hunt . |
| 4,943,180 | 7/1990 | Duhrman . |
| 4,974,352 | 12/1990 | Chen . |
| 5,040,456 | 8/1991 | Hayes . |
| 5,058,359 | 10/1991 | Lindblom . |
| 5,076,736 | 12/1991 | Grewe et al. . |
| 5,169,258 | 12/1992 | Raynak . |
| 5,388,382 | 2/1995 | Brooks . |
| 5,398,436 | 3/1995 | Suzuki . |
| 5,483,779 | 1/1996 | Crawford et al. . |
| 5,494,369 | 2/1996 | Stock . |
| 5,502,943 | 4/1996 | Hoffmann . |

*Primary Examiner*—Cassandra H. Davis
*Attorney, Agent, or Firm*—Merchant, Gould, Smith, Edell, Welter & Schmidt, P.A.

[57] ABSTRACT

An apparatus for displaying a banner includes left and right end pieces, each including a hinged bracket. Each bracket includes a guide portion having a substantially planar guide surface, and a hook portion. Cross-members extend between the end pieces to form a generally rectangular display fame. A light bar is provided which fits into cut-away portions of the brackets. A second display frame with brackets is also provided with cut-away portions for the light bar.

3 Claims, 9 Drawing Sheets

FIG. 12
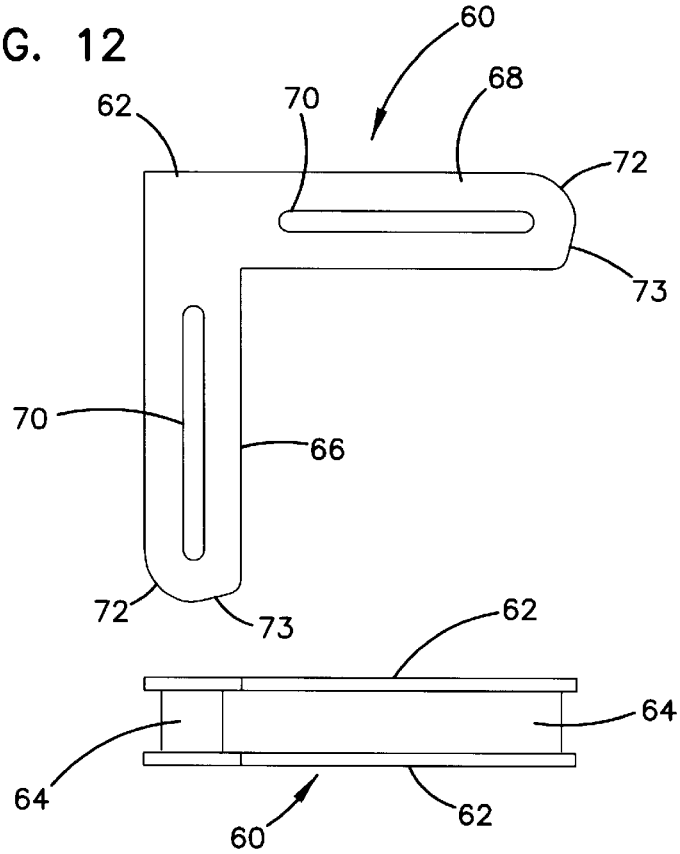
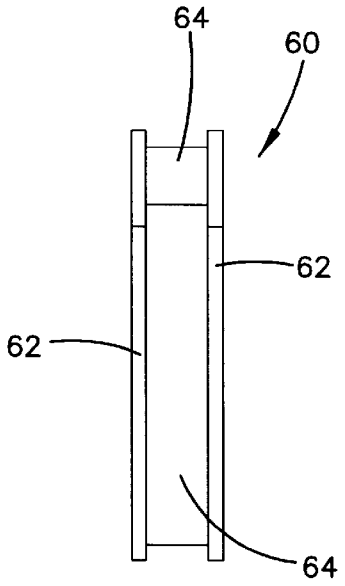
FIG. 13
FIG. 14
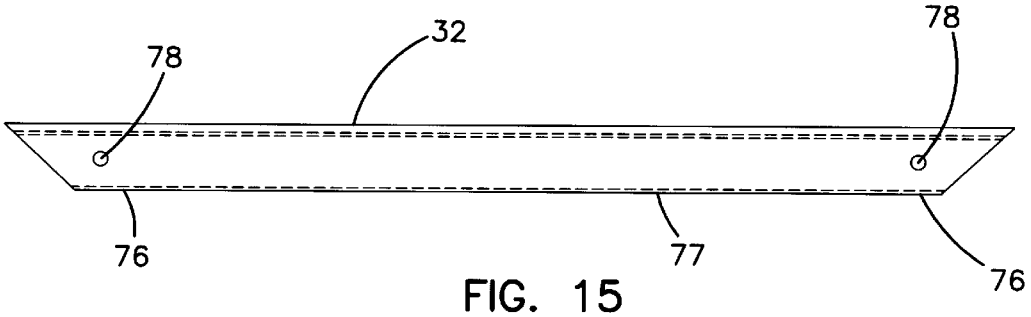
FIG. 15
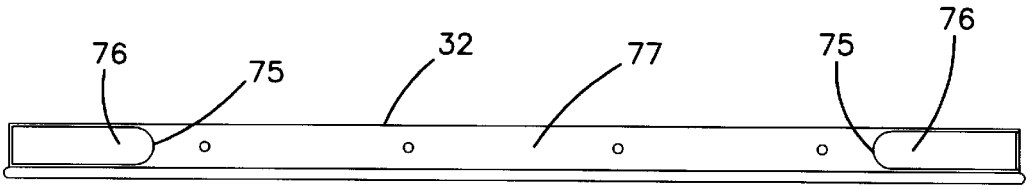
FIG. 16

CONNECTORS, DISPLAY FRAME APPARATUS AND METHOD OF USE

FIELD OF THE INVENTION

The present invention relates generally to connectors, display frames and methods of use. More particularly, the present invention relates to substantially rigid display frames, often used at trade shows to display elongated banners, and methods for using the display frames.

BACKGROUND OF THE INVENTION

Display banners or other types of elongated display mediums are often utilized to display information in an eye-catching manner. For example, it is common practice within the trade-show industry to use such banners to attract potential customers or clients to a particular trade-show display booth.

Trade-show display booths have various sizes and shapes and include a wide range of structural designs. For example, trade-show booths often incorporate collapsible, self-standing display structures that define curved display walls. For aesthetic reasons, it is desirable to span display banners across the fronts of the curved walls. Display banners are typically manufactured of flexible materials such as flexible plastic or fabric material. Because the banners are generally flexible in nature, rigid frames are often used to provide support for preventing the banners from sagging. U.S. Pat. No. 5,494,369 discloses an exemplary display frame having resilient connectors for interconnecting the various components of the frame.

Trade-show display banners are also commonly spanned between structures so as to form display "bridges". Once again, because the banners are typically made of flexible materials, rigid display frames are often used to prevent the banners from sagging. The use of rigid frames insures that the banners are presented in a clear, easy to read, and aesthetically pleasing manner. Often, the presentation and visibility of the banners is further enhanced through the use of lighting secured behind the banners.

The mobile nature of the trade-show industry presents special concerns to suppliers of rigid display frames. For example, one concern relates to providing display frames that can be quickly and easily assembled and disassembled. Another concern relates to providing display frames that are compact when disassembled. A further concern relates to providing display frames that are light weight, substantially rigid when assembled, and capable of providing large graphic display areas. Additional concerns relate to providing display frames that are durable, cost effective to manufacture, and aesthetically pleasing. The present invention addresses these concerns as well as other concerns.

SUMMARY OF THE INVENTION

One aspect of the present invention relates to a connector for interconnecting hollow ended frame members. The connector includes a first plate separated from a second plate by a resilient spacer. At least one of the plates has a bent end portion that extends toward the other plate. The bent configuration facilitates inserting the connector within the hollow ended frame members. When the connector is inserted within one of the hollow ended frame members, the resilient spacer biases the plates against interior surfaces of the frame member such that the connector is frictionally retained within the frame member. Insertion of the connector within the frame members can be further facilitated by tapering the widths of the first and second plates.

The present invention also relates to a connector that is fixedly mounted within a hollow ended frame member. The connector includes two spaced-apart plates separated by a resilient spacer. A first end of the connector is inserted within the frame member and a second end projects outward from the frame member. A fastening member fixedly retains the first end of the connector within the hollow end of the frame member. The fastening member extends through the frame member and is configured to only engage one of the spaced-apart plates. The fastening member prevents the connector from being lost and also prevents the connector from being pushed to far within the hollow ended frame member.

Another aspect of the present invention relates to an apparatus for use in constructing a display frame. The apparatus includes a first frame member having interior surfaces defining a first hollow end of the first frame member. The apparatus also includes a connector having a first plate spaced from a second plate by a resilient spacer. The connector is connected to the first frame member by a fastener and is telescopically moveable with respect to the first frame member between a retracted position and an extended position. When the connector is in the retracted position, the connector is positioned within the first hollow end of the first frame member and the first and second plates are biased by the resilient spacer into frictional engagement with interior surfaces of the first frame member. When the connector is in the extended position, the connector is pivotally movable with respect to the first frame member.

The apparatus described in the previous paragraph can be used to make a frame that is easy to assemble and disassemble. The apparatus can also be used to make an end piece of a frame that can be pivoted or folded to a compact configuration when the frame is disassembled. The apparatus can also be used to make a light weight frame that is substantially rigid.

A further aspect of the present invention relates to a rectangular frame having left and right end pieces. Brackets are connected to the left and right end pieces for connecting the frame to a support structure such as a display wall. The brackets include planar portions and hook portions. The brackets are connected to the left and right pieces by hinges having pivot axes that extend along the left and right end pieces. The pivotal arrangement of the brackets facilitates hooking the brackets over the support structure and creates a compact end piece when folded.

Another aspect of the present invention relates to a method of assembling a frame including left and right end assemblies and a plurality of cross members. The method includes the step of pivotally moving corner connectors of the left and right end assemblies from folded orientations to unfolded orientations. Next, the corner connectors are telescopically moved within end members of the end assemblies such that the end assemblies are locked in assembled orientations. The cross members are then aligned between the assembled left and right end assemblies. Finally, the cross members are interconnected between the left and right end assemblies such that the interconnected end assemblies and the cross members cooperate to form a substantially rectangular frame.

Still another aspect of the present invention relates to a method of connecting a frame to a support structure. The method includes the step of providing a substantially rectangular frame having a mounting bracket located at one end of the frame, the mounting bracket being pivotally connected to the frame and including a planar guide surface and a hook portion. The method also includes the steps of positioning the hook portion of the first mounting bracket over the first support structure and pressing the planar guide surface of the mounting bracket against the support structure such that the mounting bracket pivots to an aligned position. Once the mounting bracket is aligned, the frame is moved downward such that the hook portion hooks over the support structure to provide a connection between the frame and the support structure.

One further aspect of the present invention relates to a method of constructing a bridge between first and second support structures. The method includes the step of using a light bar to set a desired spacing distance between the first and second support structures. Next, the light bar is mounted between the first and second support structures. Finally, a first frame is mounted between the first and second support structures which previously have been separated the desired spacing distance by the light bar.

A variety of additional advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. A brief description of the drawings is as follows:

FIG. 12 is a plan view of an exemplary corner connector used in association with the frame of FIG. 3;

FIG. 13 is an end view of the connector of FIG. 12;

FIG. 14 is another end view of the connector of FIG. 12;

FIG. 15 illustrates a rear view of the end frame member the left end assembly of FIG. 9;

FIG. 16 is a side view of the end frame member of FIG. 15 which shows a wall of the end frame member that faces the interior of the frame;

DETAILED DESCRIPTION OF THE PREFERRED EMBODIMENT

Reference will now be made in detail to exemplary embodiments of the present invention which are illustrated in the accompanying drawings. Wherever possible, the same reference numbers will be used throughout the drawings to refer to the same or like parts.

Figure 1:
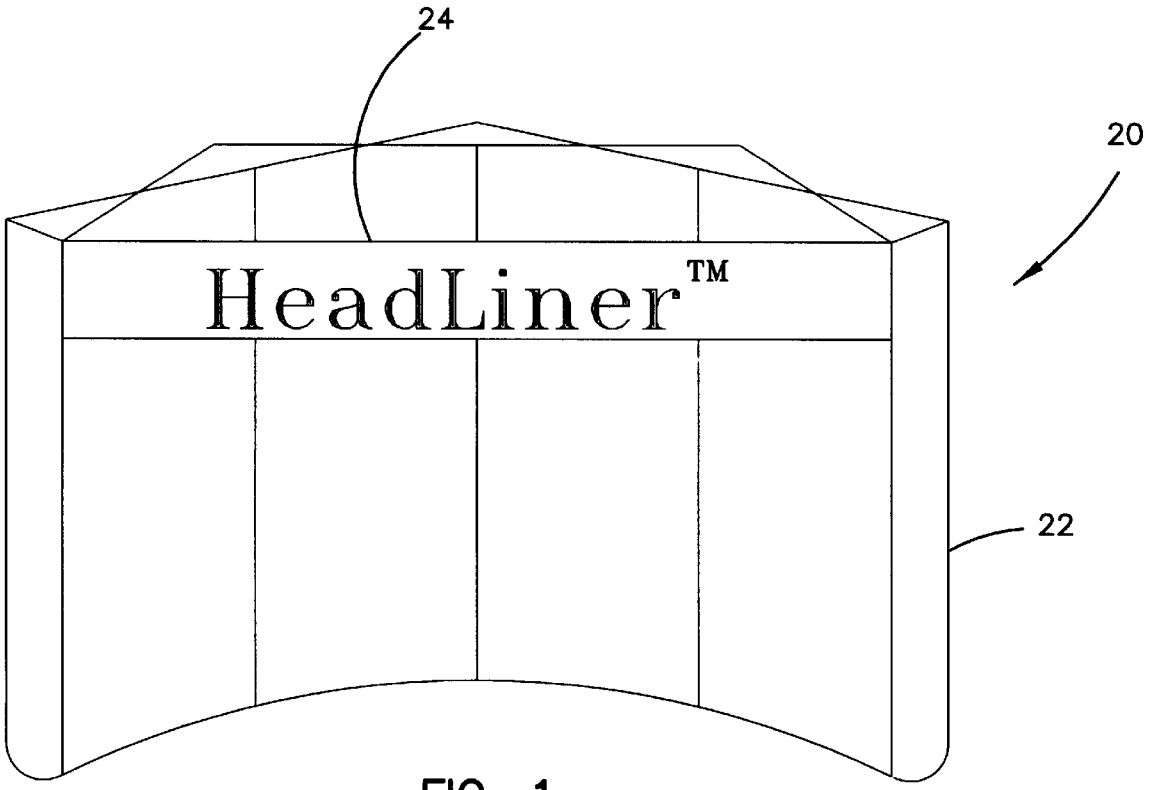
FIG. 1 illustrates a curved display wall.
Figure 2:
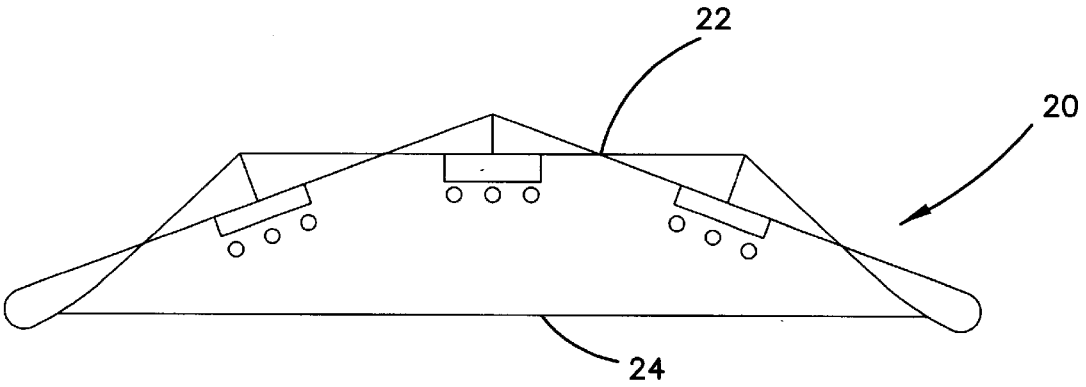
FIG. 2 is a top view of the display wall of FIG. 1.

FIGS. 1 and 2 show an exemplary display booth 20 suitable for incorporating various aspects of the present invention. The booth 20 includes a curved collapsible wall 22. The wall 22 may be constructed in a variety of manners allowing for the wall to be collapsible for storage and transport, such as described in U.S. Pat. Nos. 4,512,097, 4,280,521, 4,437,275, and Re. 31,641, the disclosures of which are incorporated by reference. A banner 24 extends across the front of the booth 20 and is preferably connected to opposite ends of the wall 22. The banner 24 is preferably made of a flexible material such as a thin sheet of plastic or a fabric material. Slogans, trademarks, company names, and any number of messages, words, phrases or graphic images are typically displayed on the banner 24. A substantially rigid frame is preferably used to prevent the banner 22 from sagging as it spans the front of the booth 20.

Figure 4:
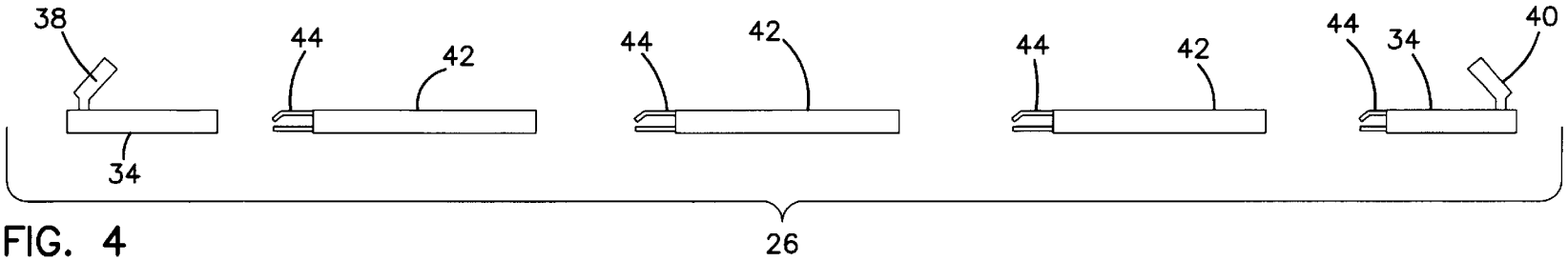
FIG. 4 is a top view of the frame of FIG. 3.
Figure 3:
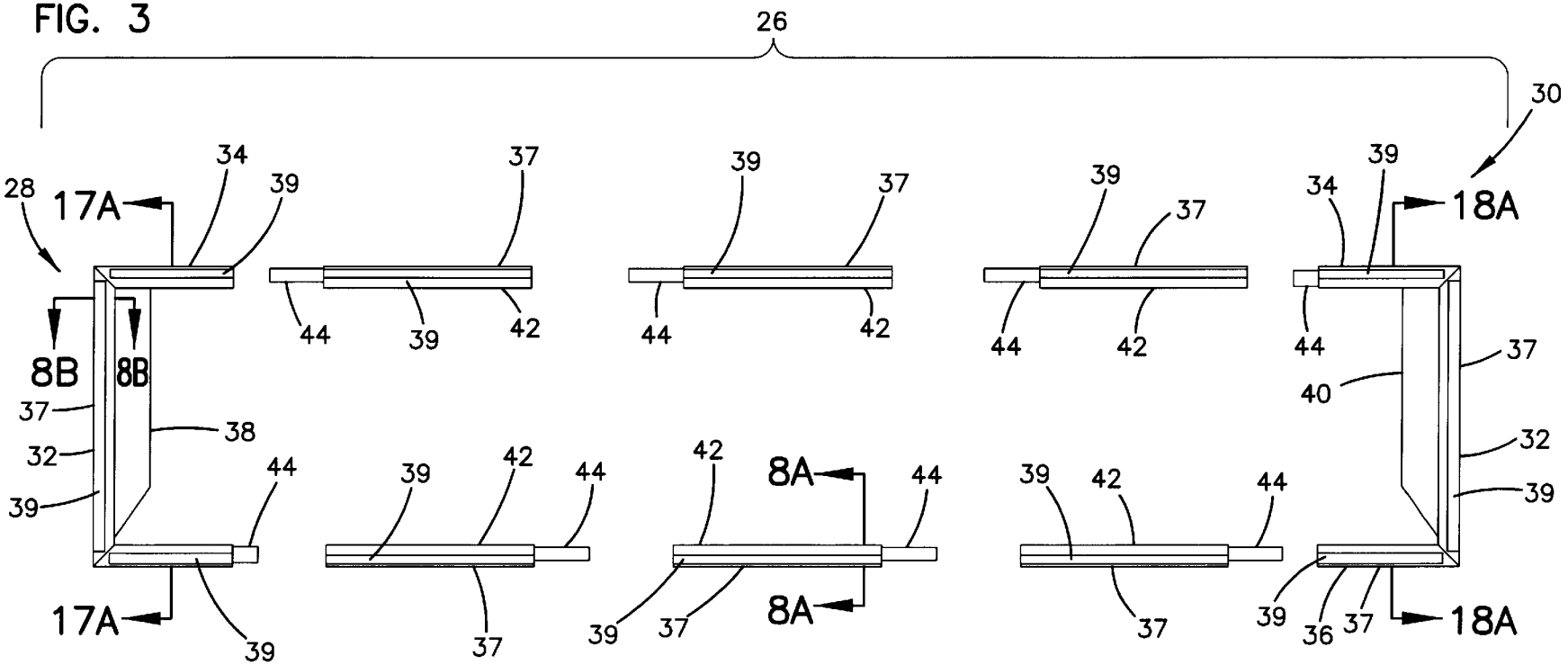
FIG. 3 is a front view of a display frame constructed in accordance with the principles of the present invention.

FIGS. 3 and 4 illustrate in exploded views a substantially rigid, generally rectangular frame 26 suitable for providing support to the banner 24 of the booth 20. Generally, the frame 26 includes a left end assembly 28 positioned opposite from a right end assembly 30. The left and right end assemblies 28 and 30 each include end frame members 32 which extend between top and bottom frame members 34 and 36. The left and right end assemblies 28 and 30 are also respectively equipped with left and right brackets 38 and 40 configured for attaching the frame 26 to a support structure such as the curved wall 22 of the booth 20. Substantially straight cross frame members 42 extend between the left and right end assemblies 28 and 30. All of the frame members of the frame 26 are preferably interconnected by resilient, frictional connectors.

The frame members 32, 34, 36, and 42 of the frame 26 are preferably hollow and formed from extruded aluminum having a substantially rectangular cross-section. The frame members 32, 34, 36, and 42 include flanges 37 that project outward from the frame members and cooperate to define a border about the perimeter of a front side of the frame 26. The border facilitates aligning a banner on the frame 26 and also improves the appearance of the banner once the banner has been mounted on the frame 26. The frame members 32, 34, 36, and 42 also include mounting strips 39 for mounting a banner on the front of the frame 26. Exemplary mounting strips include magnetic strips or hook and loop type fasteners.

It will be appreciated that suitable alternative materials such as alternative metals, plastic, resin, or composite materials can also be used to manufacture the frame members. Additionally, the frame members can have any suitable cross-sectional shape.

Figure 5:
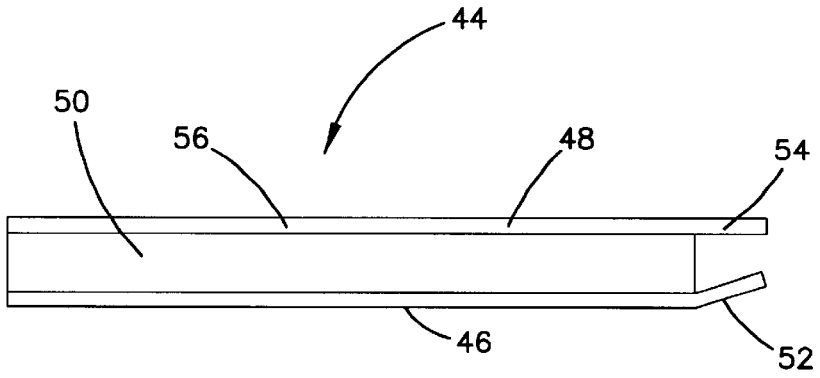
FIG. 5 is a side view of an exemplary straight connector used in association with the frame of FIG. 3.
Figure 7:
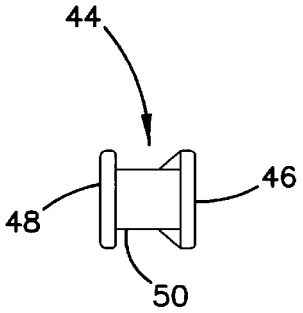
FIG. 7 is an end view of the connector of FIG. 5.
Figure 6:
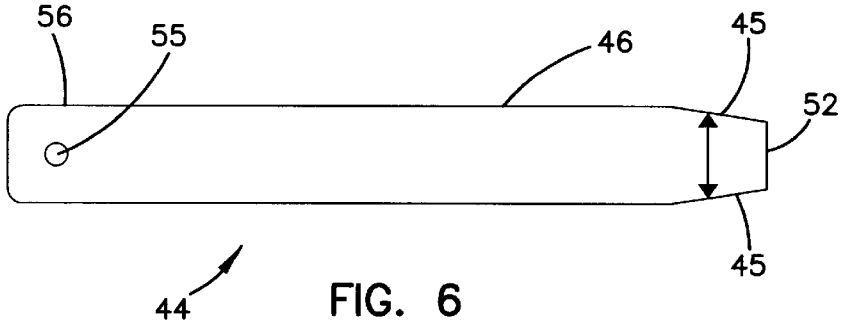
FIG. 6 is a plan view of the connector of FIG. 5.

FIGS. 5–7 show an exemplary straight connector 44 for providing straight connections between the various frame members of the frame 26. The straight connector 44 includes a first plate 46 separated from a second plate 48 by a resilient spacer 50. The plates 46 and 48 are preferably made of relatively hard materials such as aluminum or other types of metal, or hard plastic. The spacer 50 is preferably made of a resilient or elastomeric material such as silicon-based foam rubber. The spacer 50 is preferably bonded to the plates by a suitable adhesive material. Of course, it will be appreciated that elastomeric material other than silicon-based foam rubber can be used to make the spacer. Additionally, as used throughout the specification and claims, the term spacer is intended to include a wide range of resilient structures such as leaf springs, coil springs, and other structures adapted for biasing the plates apart.

The majority of the lengths of the first and second plates 46 and 48 are substantially parallel. However, a first end portion 52 of the first plate 48 tapers or slopes toward a second end portion 54 of the second plate 50. The length of spacer 50 terminates before extending into the region defined between first and second end portions 52 and 54. The tapered first end 52 facilitates inserting the connector 44 within the hollow end of a given frame member. To further facilitate inserting the connector 44 within a frame member, the widths 45 of the first and second end portions 52 and 54 are also tapered. Also, at least one of the plates 46 and 48 preferably defines an aperture 55 for receiving a rivet to allow a back end portion 56 of the connector 44 to be fixedly connected within a given frame member. Such a connection prevents loss of the connector 44, and also prevents the connector 44 from being inserted too far into a given frame member.

It will be appreciated that both the first and second plates could include bent ends and could have identical configurations. When such plates are arranged to form a connector, at least one bent end could be located on each end of the connector. Such a configuration allows either end of the connector to be easily inserted into a frame member thereby providing manufacturing and assembly advantages. Additionally, the use of identical connecting plates makes the connectors easier to manufacture.

Referring to FIGS. 3 and 4, the connector 44 is used to interconnect the individual top frame members 34, bottom frame members 36, and cross frame members 42. Preferably, the cross members 42 have connectors 44 fixedly connected within one of their hollow ends. The other ends of cross members 42 preferably remain open. Similarly, connectors 44 are preferably fixedly connected within one of the top frame members 34 and one of the bottom frame members 36. As fixedly connected, the back end portion 56 of the connector 44 is inserted within a given frame member while the first and second end portions 52 and 54 of the plates 46 and 48 extend outward from the given frame member. The connectors 44 associated with the top and bottom frame members 34 and 36 project outward a first distance from the top and bottom frame members 34 and 36. Also, the connectors 44 associated with the cross frame members 42 project a second distance outward from the cross frame members 42. To facilitate assembling the frame 26, it is preferred for the first and second distances to not be equal to one another. This prevents jamming when two cross frame members 42 are concurrently joined to the top and bottom frame members 34 and 36 at one end of the frame 26.

Figure 8A:
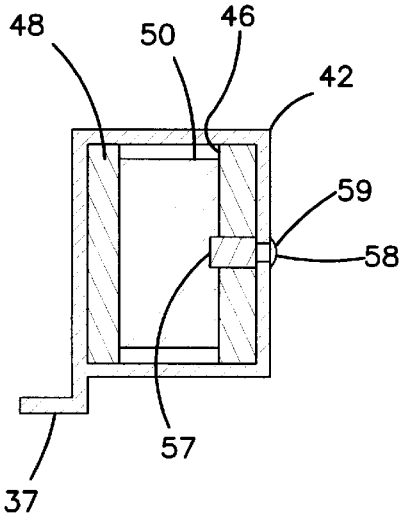
FIG. 8A is a cross-sectional view taken along section line 8A—8A of FIG. 3.

FIG. 8A shows an exemplary technique by which one of the connectors 44 is fixedly connected to one of the cross frame members 42. In FIG. 8, a pop rivet 58 is used to fasten the connector 44 to the cross frame member 42. The rivet 58 extends through a back side 53 of the cross frame member 42 and through the aperture 55 defined by the first plate 46. An end 57 of the rivet 58 is positioned between the first and second plates 46 and 48 adjacent the inner surface of the first plate 46. Of course, the end 57 could also be flush or slightly recessed with respect to the inner surface of the first plate 46. The head 59 of the rivet 58 abuts against the back side 53 of the cross frame member 42. It is desirable for the rivet 58 to extend only through the back side 53 of the frame member 42 so that the rivet 58 will not interfere with the banner which typically is mounted on the front side of the frame 26.

Figure 9:
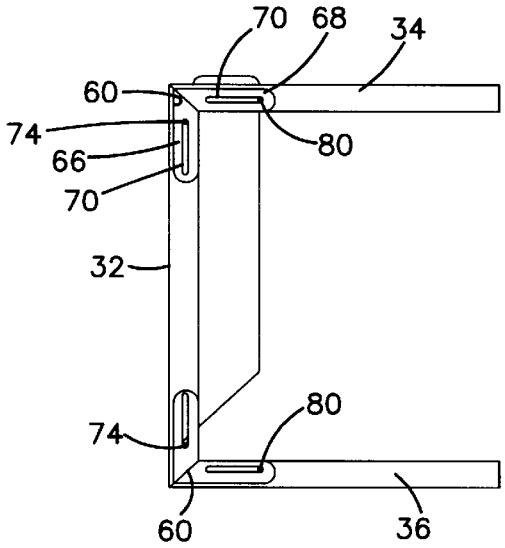
FIG. 9 is a cut-away view of the left end assembly of thee display frame of FIG. 3.
Figure 11:
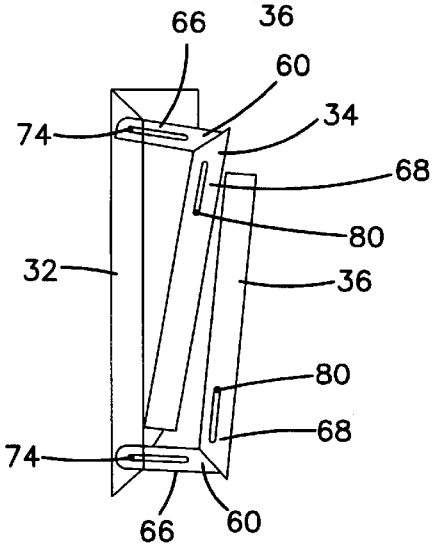
FIG. 11 shows the left end assembly of the frame of FIG. 3 in the compact orientation.
Figure 17B:
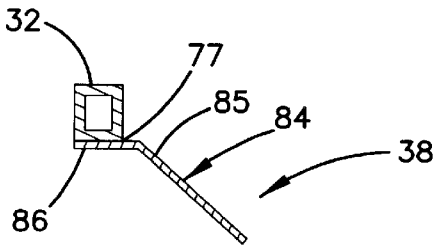
FIG. 17B is a cross-sectional view taken along section line 17B—17B of FIG. 17A.
Figure 18B:
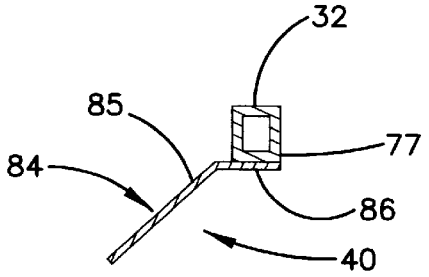
FIG. 18B is a cross-sectional view taken along section line 18B—18B of FIG. 18A.
Figure 17A:
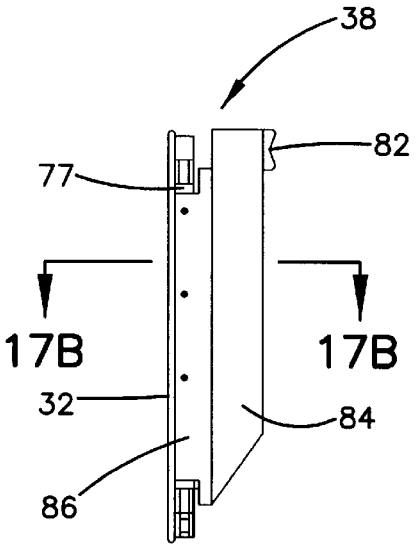
FIG. 17A is a cross-sectional view taken along section line 17A—17A of FIG. 3.
Figure 18A:
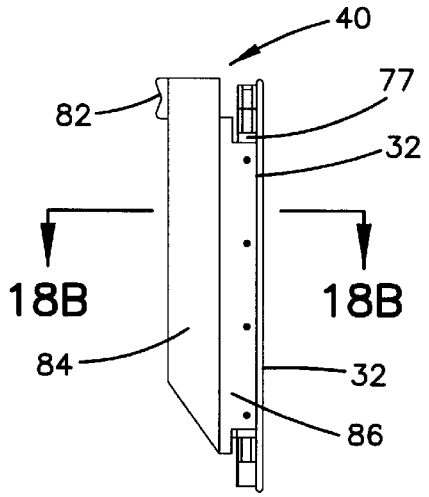
FIG. 18A is a cross-sectional view taken along section line 18A—18A of FIG. 3.
Figure 17C:
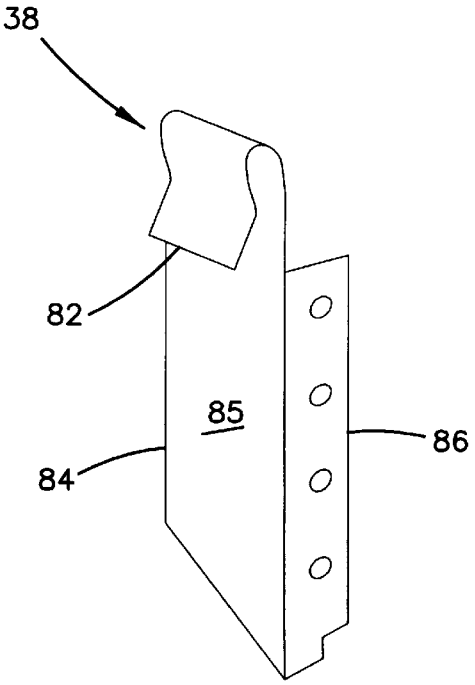
FIG. 17C is a perspective view of a left mounting bracket.
Figure 18C:
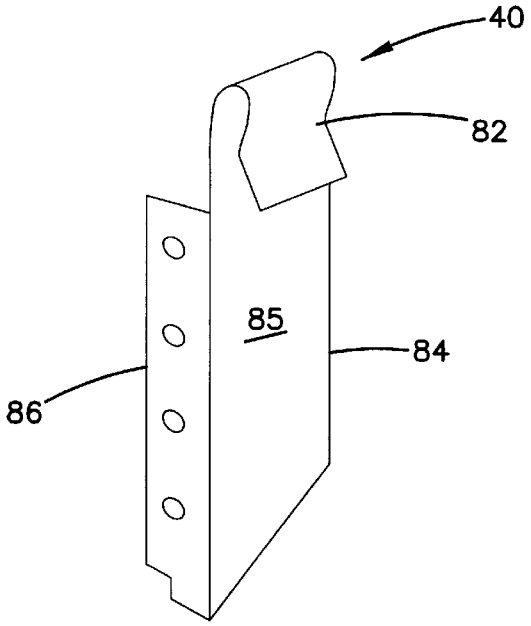
FIG. 18C is a perspective view of a right mounting bracket.

The left and right end assemblies 28 and 30 are preferably pivotally moveable between assembled orientations and compact/folded disassembled orientations. For example, FIG. 9 shows the left end assembly 28 in the assembled configuration while FIG. 11 shows the left end assembly 28 in the compact disassembled configuration. It will be appreciated that the left and right end assemblies 28 and 30 include substantially the same components and have substantially the same method of operation. Consequently, only the left end assembly 28 will be described in detail.

As previously described, the left end assembly 28 includes an end frame member 32 connected between top and bottom frame members 34 and 36. The ends of the end frame member 32 are preferably cut or sloped at 45 degree angles. Similarly, the top and bottom frame members 34 and 36 have corresponding ends cut at 45 degree angles such that when the left end assembly 28 is in the assembled configuration of FIG. 9, the top and bottom frame members 34 and 36 are arranged at right angles with respect to the end frame member 32. Corner connectors 60 are used to interconnect the end frame member 32 with the top and bottom frame members 34 and 36. It will be appreciated that the ends of the frame members can be cut at angles other that those specifically disclosed to make corners of varying configurations.

FIGS. 12–14 show a preferred design for the corner connectors 60. Each corner connector 60 includes a pair of substantially identical connecting plates 62 which are separated by a resilient spacer 64 preferably bonded between the plates 62. Each connecting plate 62 has a first end portion or leg 66 aligned at substantially right angles with respect to a second end portion or leg 68. Of course, the legs 66 and 68 can also be arranged to define angles other than right angles. Both the first and second legs 66 and 68 define elongated longitudinal slots 70 and have rounded end portions 72. Additionally, flat portions 73 are located adjacent to the rounded end portions 72.

Figure 8B:
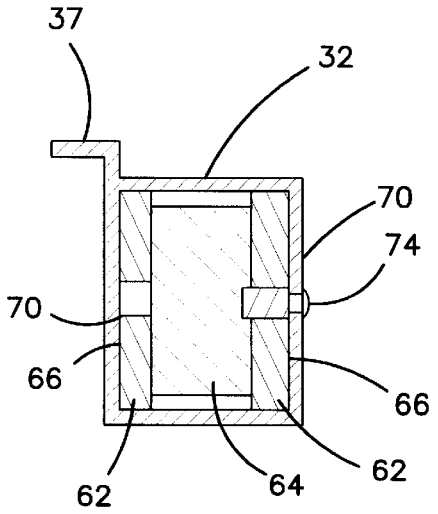
FIG. 8B is a cross-sectional view taken along section line 8B—8B of FIG. 3.

Referring to FIGS. 8B and 9, the corner connectors 60 are preferably connected to the end frame member 32 by fasteners such as pop rivets 74. Each rivet 74 preferably extends through the back side of the end frame member 32 and extends through the longitudinal slot 70 defined by the first leg 66 of one of the plates 62. The rivets 74 are preferably located in close proximity to the ends of the end frame member 32. Consequently, the first legs 66 of the plates 62 can be moved telescopically within the end frame member 32 between retracted positions (shown in FIG. 9) and extended positions (shown in FIG. 10). As the first legs 66 move within the end frame member 32, the rivets 74 slide within their respective longitudinal slots 70. Because the rivets 74 only pass through one of the plates 62, there is minimal interference between the rivets 74 and the resilient spacers 64 as the legs 66 are slid within the end frame member 32.

The pop rivets 74 used to secure the connector 60 within the end frame members 32 do not have interior heads. Therefore, by compressing the plates 62 together a sufficient distance such that the pop rivets no longer extend into the longitudinal slots 70, it is possible to remove the connectors 60 from the ends of the end frame members 32. It will be appreciated that alternative fasteners such as standard rivets, screws, bolts, and other fasteners can also be used to secure the connectors 60 within the end frame members 32. Additionally, in alternative embodiments of the present invention, the resilient spacers 64 can include slots for receiving any portion of the fasteners that project between the plates 62. The clearance provided by such slots minimizes tearing and/or abrasion of the spacers 62 as the fasteners slide along the longitudinal slots 70.

Figure 10:
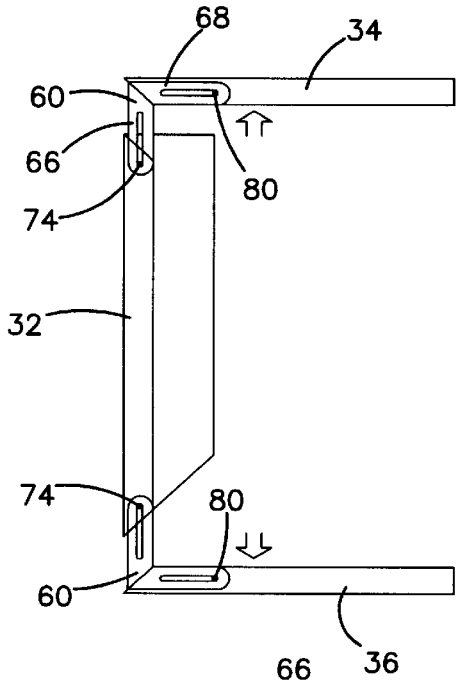
FIG. 10 shows the left end assembly in the process of being moved to a compact orientation.

When the first legs 66 of the connectors 60 are in the retracted positions as shown in FIG. 9, the first legs 66 are fully inserted within the hollow ends of the end frame member 32 and the plates 62 are biased by the resilient spacers 64 into frictional engagement with interior surfaces of the end frame member 32. The friction between the plates 62 and the end frame member 32 prevents undesired movement between the end frame member 32 and the connector 60. When the connectors 60 are manually pulled with sufficient force to overcome the friction, the first legs 66 slide within the end frame member 32 from the retracted position to the extended positions. In the extended position, as shown in FIG. 10, the legs 66 project longitudinally outward from the ends of the end frame member 32 and are aligned substantially parallel to the end frame member 32.

Once the corner connectors 60 are in the extended positions, the corner connectors 60 can be pivoted relative to the end frame member 32 about the rivets 74. Clearance for allowing the corner connectors to pivot is provided by the rounded end portions 72 of the first legs 66. The flat portions 73 located adjacent to the rounded end portions 72 help prevent the connectors 60 from over-pivoting. As best shown in FIGS. 15 and 16, clearance for allowing the corner connectors 60 to pivot is also provided by cut-away portions 76 defined by the end frame member 32. The cut-away potions 76 are defined by a wall 77 of the end frame member 32 that typically would face the interior of the frame 26. The cut-away portions 76 start at the ends of the end frame member 32 and extend longitudinally inward past rivet openings 78 defined in the back of the end frame member 32 for receiving the rivets 74. The cut-away portions 76 have inner edges 75. The clearance provided by the rounded ends 72 and the cut-away portions 76 allows the legs 66 to be pivoted from the extended position, where the legs 66 are substantially parallel to the end frame member 32, to the compact orientation where the legs 66 form oblique angles relative to the end frame member 32 (as shown in FIG. 11).

The second legs 68 of the corner connectors 60 are preferably fixedly connected to the top and bottom frame members 34 and 36 by one or more rivets 80. The rivets 80 extend through back sides of the top and bottom members 34 and 36 and also extend through at least one of the longitudinal slots 70 defined by the second legs 68 of each connector 60. The rivets 80 are preferably positioned such that the second legs 68 are not free to slide relative to the top and bottom frame members 34 and 36. It will be appreciated that the longitudinal slots 70 defined by the second legs 68 of the corner connectors can be replaced with single openings through at least one of the second legs 68 of each corner connector 60. The openings would be sized to receive the rivets 80 so as to provide a fixed connection between the connectors 60 and the top and bottom frame members 34 and 36. It is preferred to have longitudinal slots formed in all of the legs of the connector 60 so that either end of the connector 60 can be pivotally mounted within the end members 32 of the frame 26. Such uniformity facilitates assembly of the frame 26.

FIGS. 17A–C and 18A–C show additional views of the left and right mounting brackets 38 and 40. Each of the brackets 38 and 40 includes a resilient hook portion 82 configured to be hooked over a support structure, such as the wall 22 of the booth 20. A guide portion 84 is integrally formed with each hook portion 82. The guide portions 84 have a planar guide surfaces 85 including portions which are spaced-apart from and directly oppose the hook portions 82. Connecting portions 86 are also integrally formed with the guide portions 84. The connecting portions 86 are riveted to the inner walls 77 of the end frame member 32. The connecting portions 86 are aligned at oblique angles with respect to the guide portions 84. The sizes of the oblique angles are determined by the configuration of the support structure on which the frame 26 is desired to be hung. FIG. 4 illustrates an exemplary oblique angle configuration which allows attachment of the mounting brackets 38 and 40 to a curved wall 22.

During shipment and storage, the frame 26 is preferably oriented in a compact configuration in which the end assemblies 30 and 32 are folded/pivoted to the compact configuration (shown in FIG. 11) and arranged in a compact bundle with the straight frame members 42. When it is desired to assemble the frame 26, the end assemblies 28 and 30 are moved from the compact configuration of FIG. 11 to the assembled configuration of FIG. 9. This is accomplished by pivoting the top and bottom members 34 and 36 to the extended orientation of FIG. 10, and then sliding the first legs 66 of the connectors 60 from the extended orientation to the retracted orientation of FIG. 9. Once the end assemblies 28 and 30 are assembled, the end assemblies 30 and 32 and the straight frame members 42 are then arranged as shown in FIG. 3. After the frame components are arranged as shown in FIG. 3, the exposed ends of the straight connectors 44 are inserted within openings in the frame members such that the frame members are interconnected. As inserted, the resilient spacers 50 bias the connectors 44 into frictional engagement with interior surfaces of the frame members such that the connections are securely maintained. A banner is then mounted on the front of the assembled frame 26 and the frame 26 is hung on a support structure via the hooked brackets 38 and 40.

When the display is no longer needed, the frame 26 is removed from the support structure and the banner is removed from the frame 26. Next, the frame members 34, 36, and 42 are pulled apart. The end assemblies 30 and 32 are then moved from the assembled configuration of FIG. 9 to the compact configuration of FIG. 11 by pulling the first legs 66 from within the end members 32, and then pivoting the top and bottom frame members 34 and 36 about the rivets 74. Finally, the various components are arranged in a compact bundle.

Figure 19:
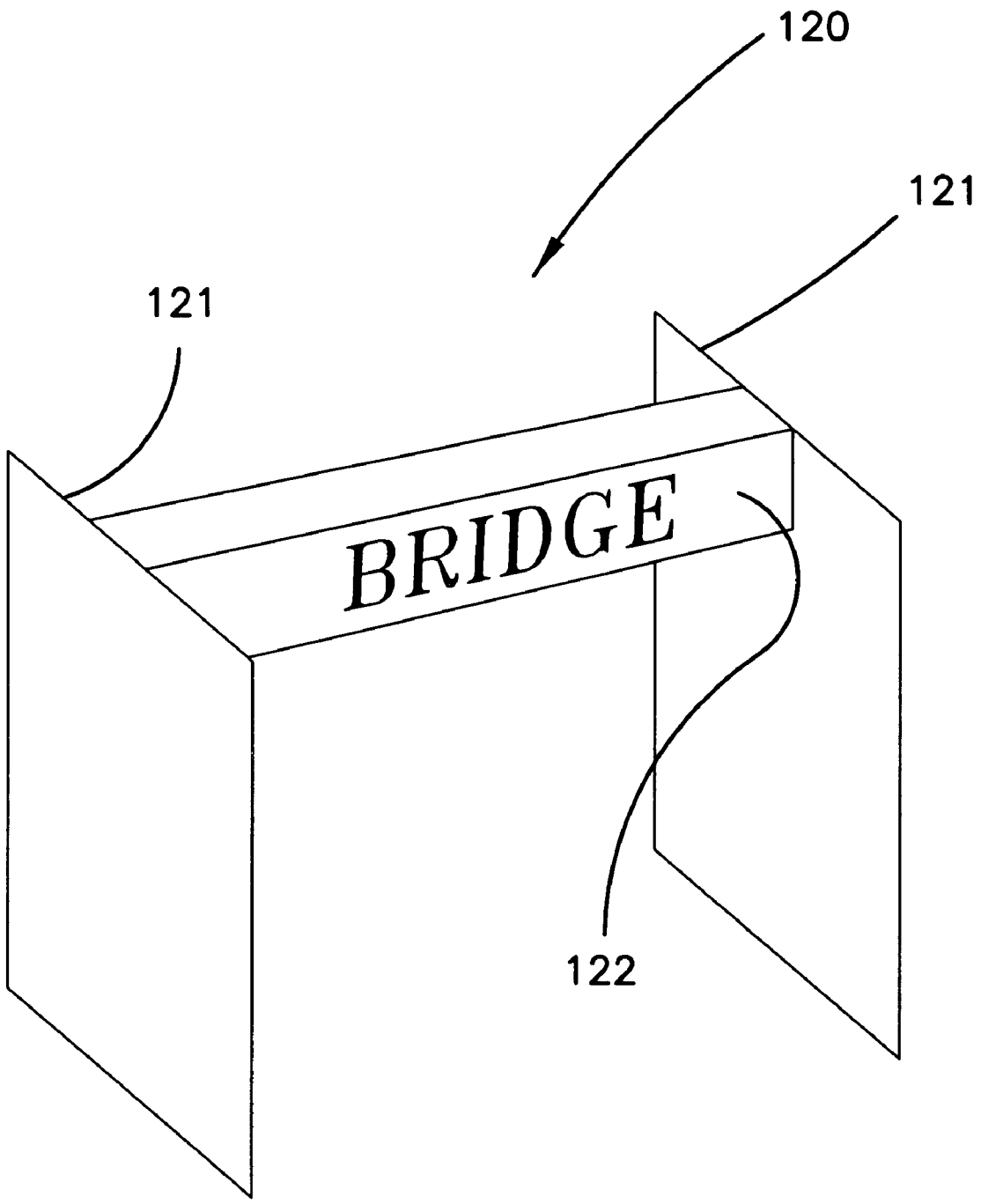
FIG. 19 illustrates a display bridge extending between two support structures.

FIG. 19 shows a bridge 120 extending perpendicularly between two support structures 121. Support structures 121 can be planar as shown, or curved. The bridge 120 includes a front banner 122 and a back banner (not shown). A light bar is preferably mounted between the front and back banners for illuminating the banners. Additionally, front and back frames are used to prevent the banners from sagging.

Figure 20:
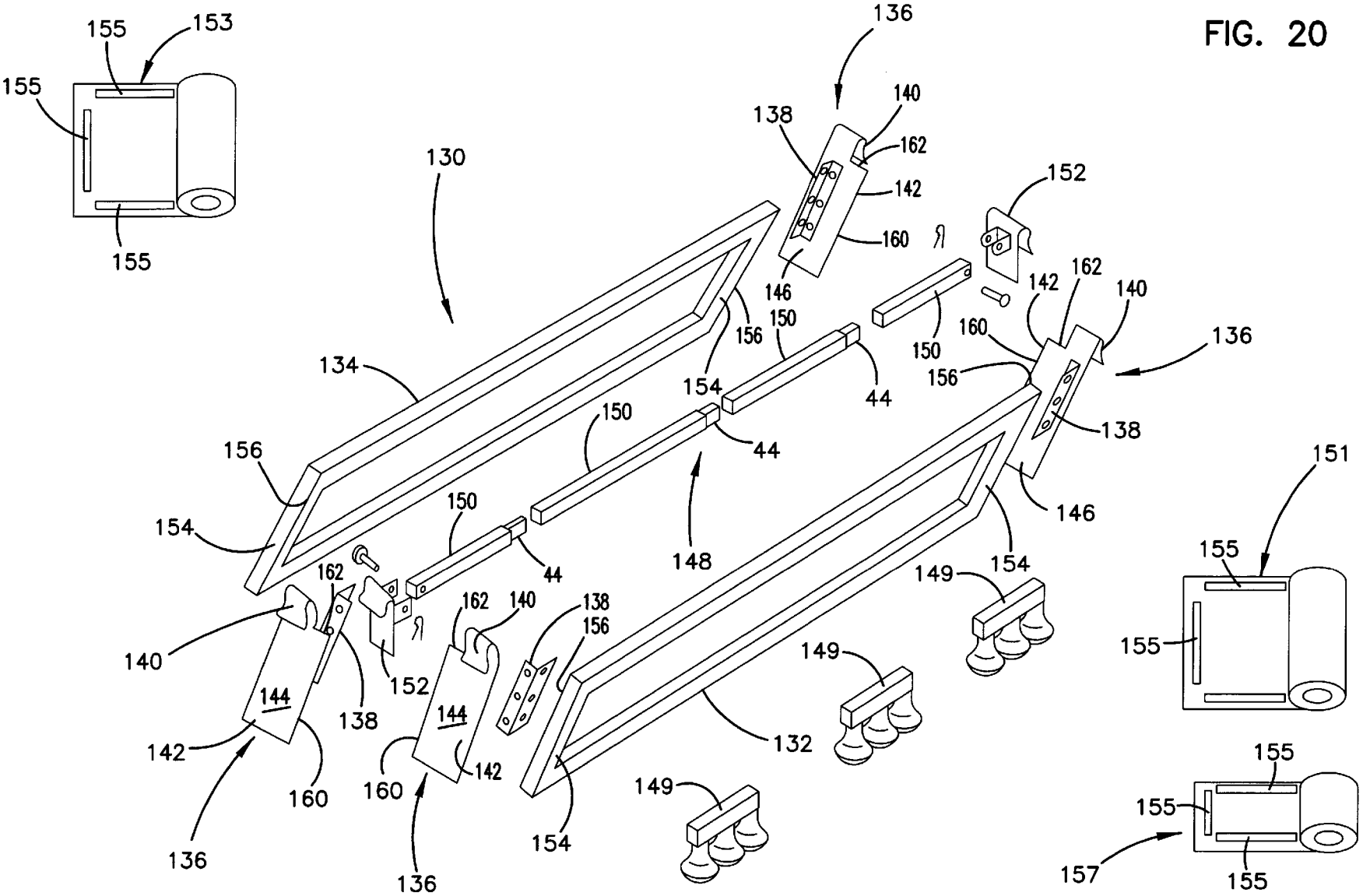
FIG. 20 shows exemplary display frames used to assemble the display bridge of FIG. 19.

FIG. 20 shows an exploded view of a bridge assembly 130 constructed in accordance with the principles of the present invention. The bridge assembly 130 includes front and back frames 132 and 134 that preferably have substantially the same construction as the frame 26 of FIGS. 3 and 4. However, to facilitate mounting the frames 132 and 134 between spaced-apart support structures, mounting brackets 136 are pivotally connected to the ends of the frames 132 and 134 by pivotal hinges 138. The mounting brackets 136 are preferably made of plastic and include hook portions 140 that are integrally formed with rectangular guide portions 142. The guide portions 142 include front and back planar surfaces 144 and 146. The front planar surfaces 144 have portions which generally oppose and are spaced-apart from the hook portions 140. The hinges 138 are connected to the back planar surfaces 146.

The bridge assembly 130 also includes a light bar 148 positioned between the front and back frames 132 and 134. The light bar 148 includes a plurality of segments or frame members 150 that are interconnected by resilient connectors 44. The light bar 148 is mounted on support structures through the use of hooked mounting brackets 152. It is preferred for the light bar 148 to be pinned to the hooked mounting brackets 152.

Figure 21:
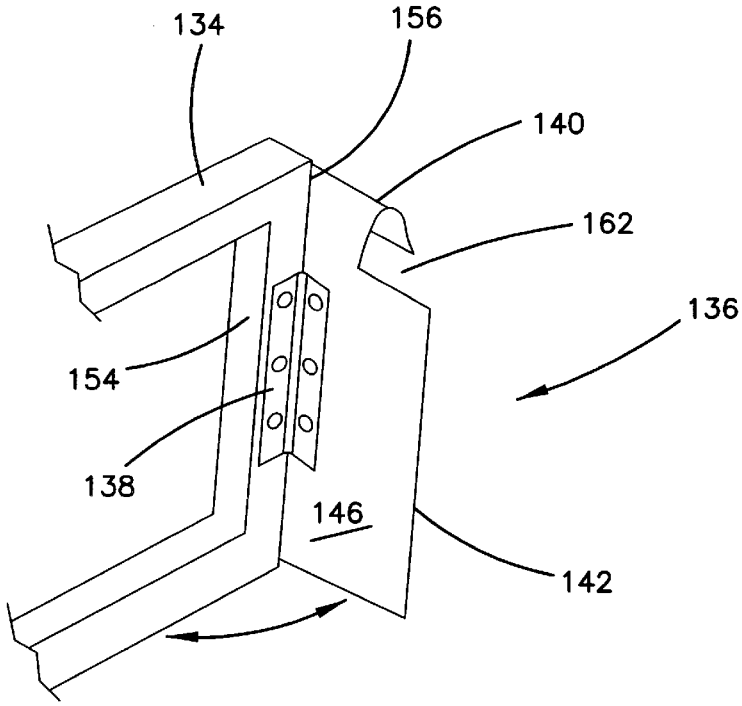
FIG. 21 shows a pivoted bracket used to mount the display bridge of FIG. 19 between the support structures.

The hinges 138 are preferably connected to end members 154 of the frames 132 and 134. Specifically, the hinges are preferably riveted to surfaces of the end members 154 that face the light bar 148. As shown in FIG. 21, the hinges 138 are preferably oriented such that the hinge pins, or pivot axes of the hinges 138, extend longitudinally along the end members 154. More specifically, the pivot axes of the hinges 138 preferably extend along inside corners or edges 156 of the end members 154. The hinges 138 are connected to the brackets 136 at intermediate regions 137 of guide portions 142 such that portions of the guide portion 142 are located on opposite sides of the hinge pins. In this manner, interference between the brackets 136 and the end members 154 limits the hinges 138 to approximately 90 degrees of pivotal movement. Additionally, the arrangement of the hinges 138 allows the brackets to self-align when the frames 132 and 134 are mounted. Specifically, the brackets self-align when the front or alignment surfaces 144 of the brackets are pressed against support structures thereby causing the brackets to pivot to aligned positions relative to the support structures.

Figure 22A:
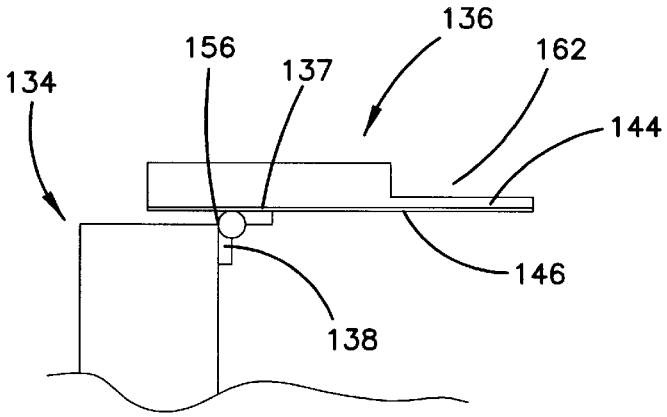
FIG. 22A is a top view of the pivoted bracket of FIG. 21, the bracket is in an aligned position.
Figure 22B:
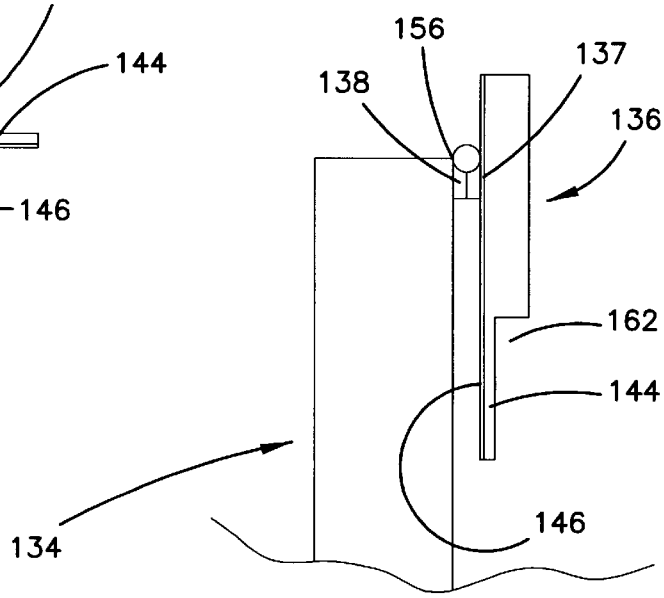
FIG. 22B is a top view of the pivoted bracket of FIG. 21, the bracket is in a folded position.

FIGS. 22A and 22B illustrate the range of pivotal movement between the brackets 136 and the frame 132. FIG. 22A shows the bracket 136 in an aligned position in which the frame 132 is configured to extend perpendicularly outward from a support structure. FIG. 22B shows the bracket 136 in a compact folded orientation which is typically suited for storing the frame 132.

To set up the bridge assembly 130, the light bar 148 is first assembled and then mounted perpendicularly between first and second support structures via the mounting brackets 152. In this manner, the light bar 148 is used to set a desired spacing between the support structures prior to attempting to mount the larger, and significantly more awkward frames 132 and 134 between the support structures. Prior to mounting the light bar 148, the light bar 148 can be placed on the ground between the support structures and used as a measuring tool for setting the approximate spacing between the structures.

Once the light bar 148 is mounted in place, lights 149 are attached to the light bar 148 by conventional techniques such as brackets, bolts, straps, ties, etc. Next, the frames 132 and 134 are assembled and front and back banners 151 and 153 displaying graphic images are unrolled and mounted on the frames 132 and 134. The banners 151 and 153 preferably include mounting strips 155, such as hook and loop fasteners or magnetic strips, that cooperate with corresponding mounting strips on the frames 132 and 134 to attach the banners 151 and 153 to the frames 132 and 134.

One of the frames 132 and 134 is then hung between the support structures via the pivotal mounting brackets 136. For example, the front frame 132 is hung by maneuvering the frame 132 such that the hook portions 140 of the mounting brackets 136 are located above the support structures, and the front surfaces 144 of the mounting bracket guide portions 142 engage the support structures. Contact between the front surfaces 144 of the brackets 136 and the support structures causes the brackets 136 to pivot relative to the frame 132 such that the hook portions 140 self-align directly above the support structures. The frame 132 is then maneuvered generally vertically downward causing the hook portions 140 to hook over the support structures thereby connecting the frame 132 between the support structures. The other frame 134 is then connected between the support structures in a similar manner such that the light bar 148 is positioned between the frames 132 and 134. The frames 132 and 134 are preferably pushed together such that inside edges 160 of the mounting brackets 136 contact each other. The brackets 136 include notches 162 for providing clearance for the light bar 148 when the frames are pushed together. Once the frames 132 and 134 are mounted in place, a light diffuser 157 is unrolled and mounted below the frames 132 and 134 by such means as mounting strips 155. Once the diffuser 157 is in place, the bridge assembly 130 is completely assembled.

With regard to the foregoing description, it is to be understood that changes may be made in detail, especially in matters of the construction materials employed and the shape, size, and arrangement of the parts without departing from the scope of the present invention. It is intended that the specification and depicted embodiment be considered exemplary only, with a true scope and spirit of the invention being indicated by the broad meaning of the following claims.

What is claimed is:

1. An apparatus for displaying a banner, the apparatus comprising:

left and right end pieces;

first left and right brackets respectively secured to the left and right end pieces, the first left and right brackets including guide portions having substantially planar guide surfaces, and hook portions which are connected with the guide portions and which are spaced-apart from the planar guide surfaces;

at least one hinge that pivotally connects at least one of the first left and right brackets to at least one of the left and right end pieces, respectively, the at least one hinge having a pivot axis extends along the at least one left and right end piece; and a plurality of substantially straight cross-members extending between the left and right end pieces, the left and right end pieces and the cross-members being adapted to form a generally rectangular first display frame.

2. The apparatus of claim 1, further comprising a light bar, wherein the first left and right brackets have first cut-away portions sized to provide clearance for the light bar.

3. The apparatus of claim 2, further comprising a second display frame configured to be mounted on an opposite side of the light bar from the first display frame, the second display frame having second left and right mounting brackets including second cut-away portions sized to provide clearance for the light bar.

* * * * *